US008147887B2

(12) United States Patent
Dogan et al.

(10) Patent No.: US 8,147,887 B2
(45) Date of Patent: Apr. 3, 2012

(54) BEVERAGE INGREDIENT CAPSULE WITH OPENING PLATE HAVING PRESSURE RELIEF OPENINGS

(75) Inventors: Nihan Dogan, La Croix-sur-Lutry (CH); Olivier Villain, Grandvaux (CH); Frederic Doleac, Jougne (FR); Eckhard Seid, Orbe (CH); Jean-Francois Combart, Vuillafans (FR)

(73) Assignee: Nestec S.A., Vevey (CH)

( * ) Notice: Subject to any disclaimer, the term of this patent is extended or adjusted under 35 U.S.C. 154(b) by 236 days.

(21) Appl. No.: 12/532,059

(22) PCT Filed: Mar. 20, 2008

(86) PCT No.: PCT/EP2008/053356

§ 371 (c)(1),
(2), (4) Date: Sep. 18, 2009

(87) PCT Pub. No.: WO2008/116818

PCT Pub. Date: Oct. 2, 2008

(65) Prior Publication Data

US 2010/0034929 A1 Feb. 11, 2010

(30) Foreign Application Priority Data

Mar. 23, 2007 (EP) ..... 07104813

(51) Int. Cl.

| | |
|---|---|
| ***B65B 29/02*** | (2006.01) |
| *A23L 1/00* | (2006.01) |
| *A23G 3/00* | (2006.01) |
| *A47J 31/44* | (2006.01) |
| *A47J 31/057* | (2006.01) |
| *A47J 31/06* | (2006.01) |

(52) U.S. Cl. ..... 426/77; 426/89; 426/90; 426/78; 99/295; 99/300; 99/279

(58) Field of Classification Search ..... 426/77, 426/89, 90, 78; 99/295, 300, 279
See application file for complete search history.

(56) References Cited

U.S. PATENT DOCUMENTS

| | | | | |
|---|---|---|---|---|
| 5,314,074 | A * | 5/1994 | Inbar et al. | 209/208 |
| 2002/0078831 | A1 | 6/2002 | Cai | |
| 2006/0219098 | A1 * | 10/2006 | Mandralis et al. | 99/279 |
| 2010/0282091 | A1 * | 11/2010 | Doleac et al. | 99/295 |

FOREIGN PATENT DOCUMENTS

| | | |
|---|---|---|
| EP | 0007876 | 2/1980 |
| EP | 1579792 | 9/2005 |
| EP | 1580144 | 9/2005 |
| EP | 1580144 A1 * | 9/2005 |
| WO | WO 2006/021405 | 3/2006 |

OTHER PUBLICATIONS

International Search Report dated May 20, 2008. Written Opinion of the International Searching Authority dated May 20, 2008.

* cited by examiner

*Primary Examiner* — Humera Sheikh
*Assistant Examiner* — Subbalakshmi Prakash
(74) *Attorney, Agent, or Firm* — K&L Gates LLP

(57) ABSTRACT

A capsule (1) containing ingredients for producing a beverage, wherein the ingredients are housed in a compartment (3), wherein the capsule (1) comprises a contoured opening plate (5) designed for opening a face of the compartment (3) when the pressure inside the ingredient compartment (3) presses the face against the opening plate (5) of the capsule (1), or an insert and wherein the opening plate (5) or insert is provided with one or several capillary through holes (100, 101, 102, 103) connecting two opposing sides of the opening plate (5) or insert.

12 Claims, 7 Drawing Sheets

BEVERAGE INGREDIENT CAPSULE WITH OPENING PLATE HAVING PRESSURE RELIEF OPENINGS

Figure 1:
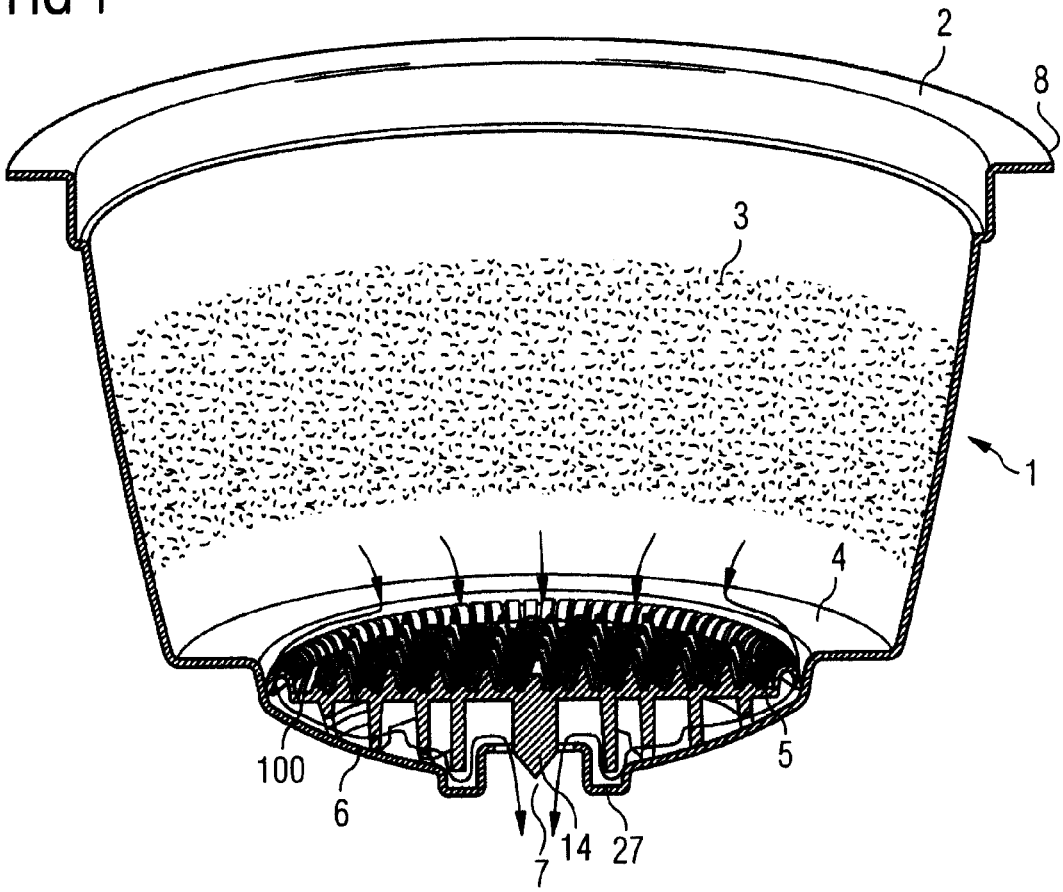

The present invention generally relates to the field of producing beverages or other liquid comestibles (soups etc.) using an ingredient-containing capsule.

When a beverage production machine injects a liquid, such as for example water, into the interior of the ingredient-containing capsule, the water interacts with the ingredients contained in the capsule. The result of the interaction is that a beverage or a liquid comestible is obtained from the capsule.

The invention particularly relates to the field of capsules in which, during manufacture of the capsule, the ingredients are hermetically sealed in a compartment of the capsule. In other words, an exposure of the ingredients to the ambience is only produced after the capsule has been inserted into a beverage production machine, which usually has means for perforating an inlet face of the capsule, means for injecting water into the capsule and means for carrying the capsule in a defined position. Thus the invention targets at capsules which are opened by dedicated opening means of the dedicated beverage production machine.

The hermetically sealed capsule is of advantage as it avoids a premature loss of volatile substances of the ingredients during transport or storage.

In the beverage production process the capsule is opened both at an inlet side and at an outlet side. Although the biggest portion of the liquid introduced into the interior of the capsule will be drained, there will always some residual liquid remaining in the capsule after the beverage production process.

Particularly when the capsule is then taken out from the beverage production machine, there is the problem of water or beverage dripping e.g. from the water inlet side of the capsule. It is thought that this dripping is particularly promoted by air entering the capsule from the beverage outlet side.

Sometimes this problem is even aggravated when the beverage leaving the water inlet side of the capsule causes even solids such as coffee powder to leave the capsule on the water inlet side. This can lead to a cross-contamination of elements of the beverage production machine, which constitutes a particular problem when the beverage production machine is used for different beverages (e.g. coffee, tea, juice, milk . . . ).

The invention therefore has the object to reduce the risk of residual liquids and/or solids leaving the capsule after the completion of the beverage production process.

This object is achieved by means of the features of the independent claims. The depending claims develop further the central idea of the present invention.

A first aspect of the invention pertains to a capsule containing ingredients for producing a beverage. The ingredients are housed in a compartment. The capsule comprises a contoured opening plate designed for opening a face of the ingredient compartment when the pressure inside the ingredient compartment presses the face against the opening plate of the capsule. The opening plate is provided with one or several capillary through holes connecting two opposing sides of the opening plate.

The through holes can have a diameter e.g. of between 0.1 mm and 0.7 mm, preferably between 0.2 and 0.7 mm.

Preferably 1 to 10, most preferred 2 to 5 through holes are provided.

The through hole(s) can be arranged in recessed portions of the face of the opening plate which faces the compartment face to be opened.

The through hole(s) are arranged in a periodic pattern over the opening plate.

The opening plate can be provided with valve means which can be part of the plate or be integral with the plate.

In a specific mode, the valve means are designed for

- opening a liquid flow path between the periphery of the opening plate and the capsule wall as long as the pressure inside the ingredient compartment exceeds a threshold value, and
- closing off liquid flow path when the pressure inside the ingredient compartment drops below a threshold value.

The valve means can comprise a flexible lip provided at the periphery of the opening plate which is deformed under the effect of the pressure of fluid building up in the chamber. The flexible lip thus leaves a gap at the periphery of the plate between the plate and the sidewall of the capsule which is sufficient for beverage to be released at a sufficient flow rate.

In a different aspect, the invention relates to a capsule containing ingredients for producing a beverage, wherein the ingredients are housed in a compartment, wherein the capsule comprises an insert placed between the compartment and the outlet, wherein the insert comprises or is part of a valve means, characterized in that the insert is provided with one or several capillary through-holes connecting two opposing sides of the insert.

The valve means can be part of the insert or be integrally formed of the plate. The valve means can be designed for

- opening a liquid flow path between the periphery of the insert and the capsule wall as long as the pressure inside the ingredient compartment exceeds a threshold value, and
- closing off liquid flow path when the pressure inside the ingredient compartment drops below a threshold value.

In a mode, the insert is an opening plate designed for opening a face of the ingredient compartment when the pressure inside the ingredient compartment presses the face against the opening plate of the capsule.

Further aspects, objects and advantages of the present invention will become evident from the following description of preferred embodiments of the present invention taken in conjunction with the figures of the enclosed drawings.

Figure 2:
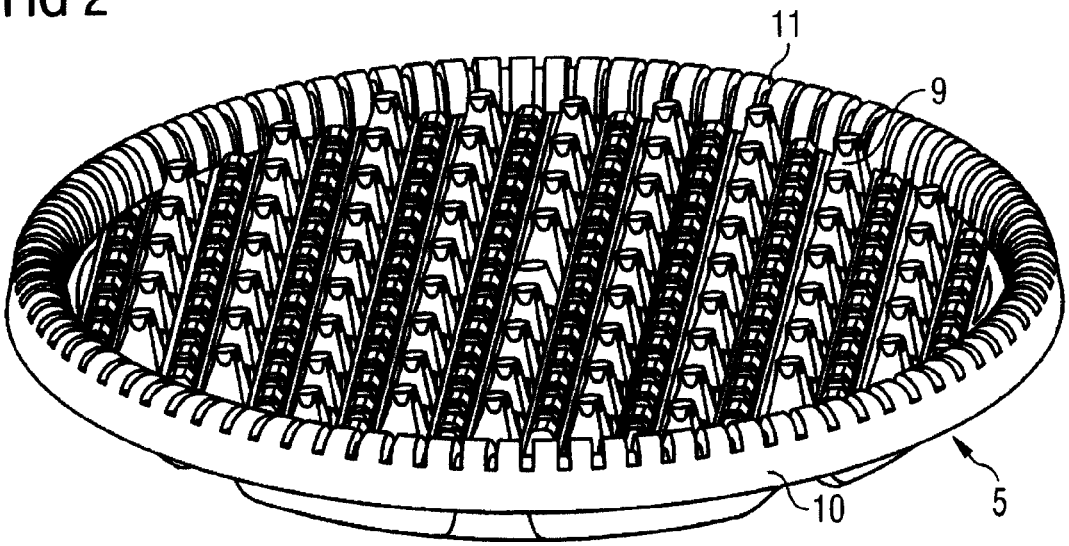
Figure 3:
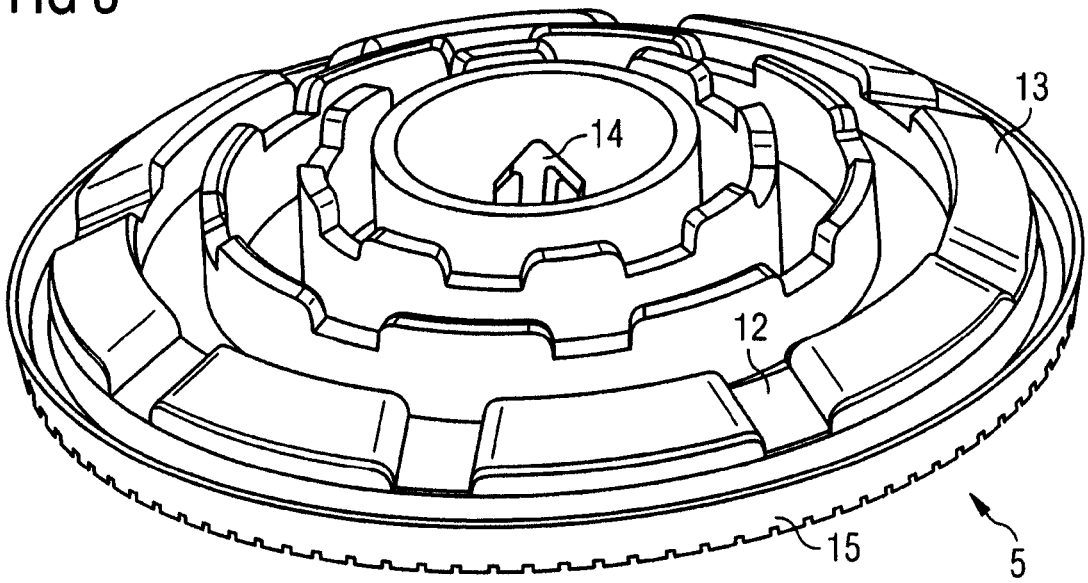
Figure 4:
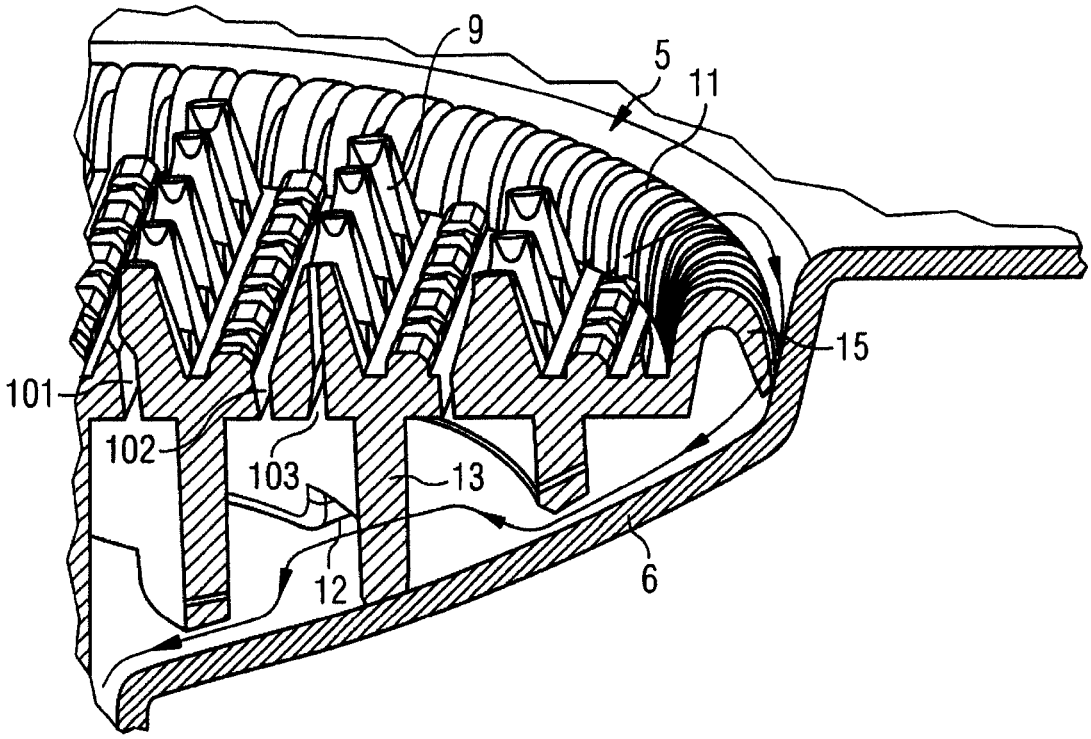
Figure 5:
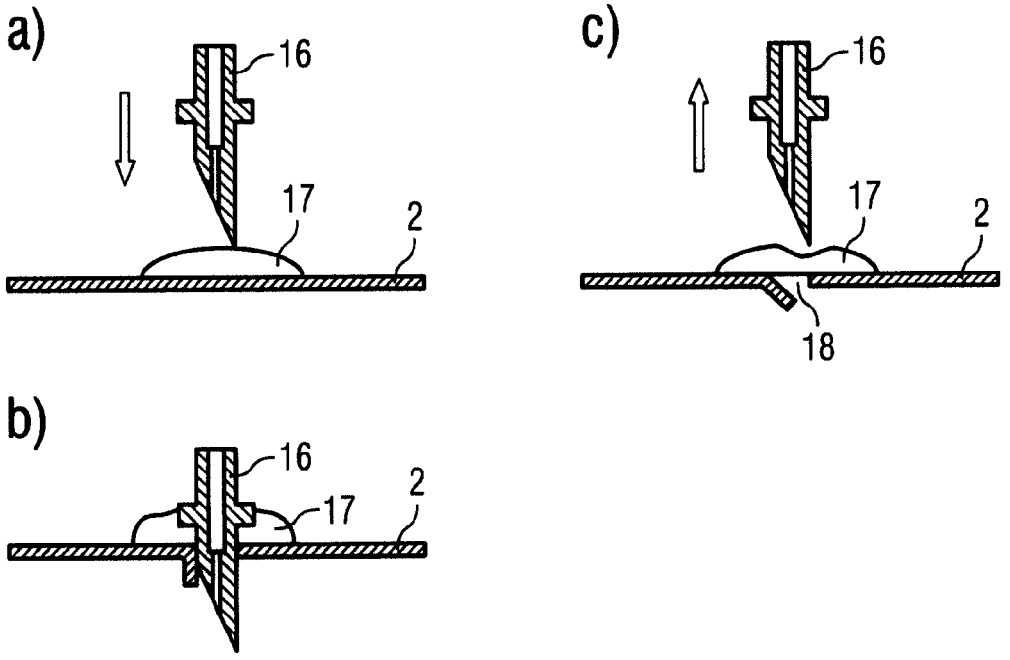
Figure 6:
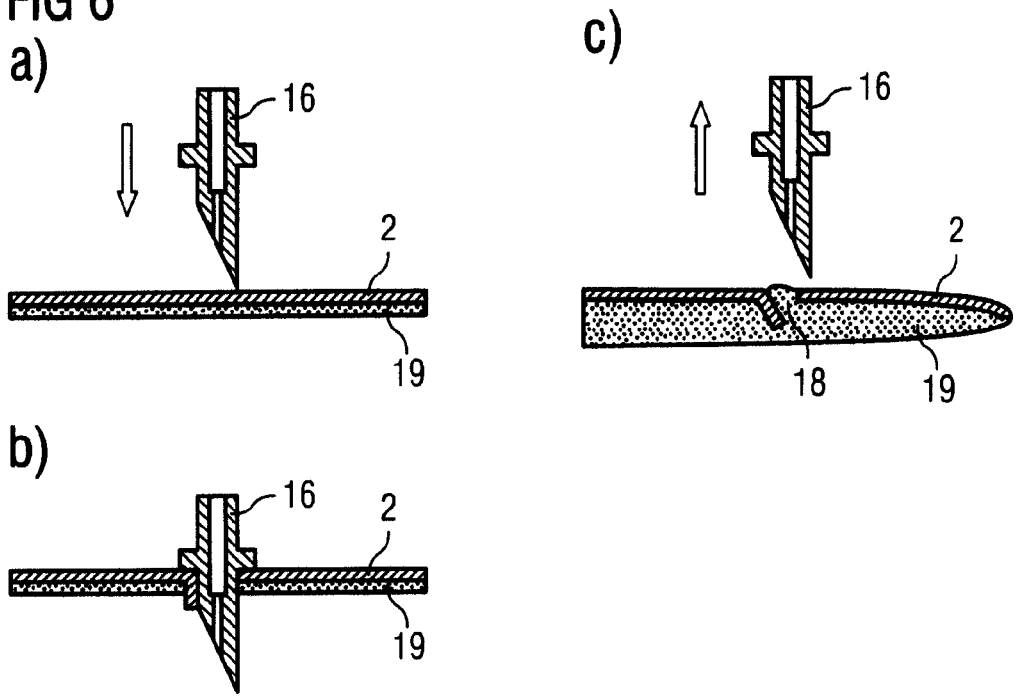
Figure 7:
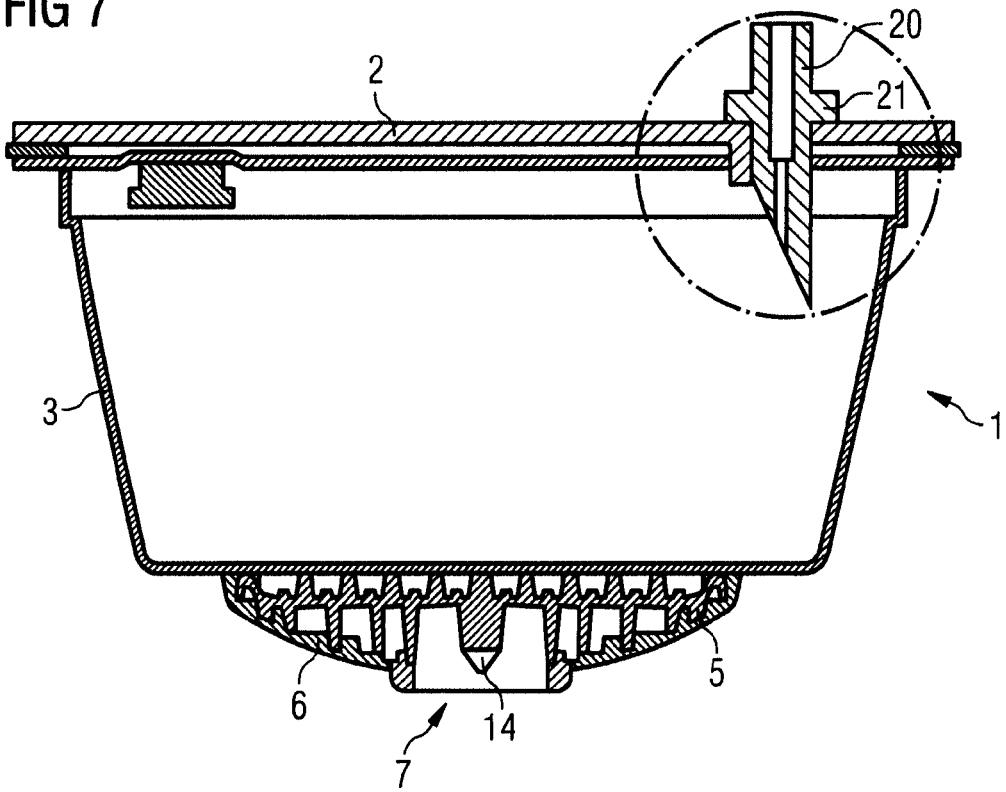
Figure 8:
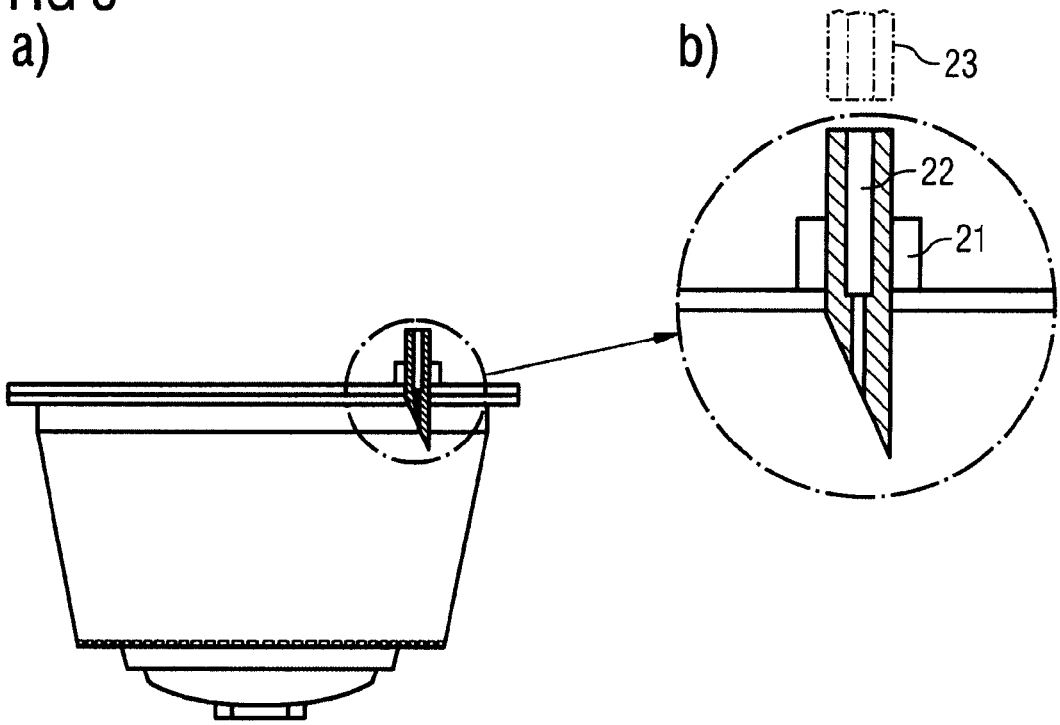
Figure 9:
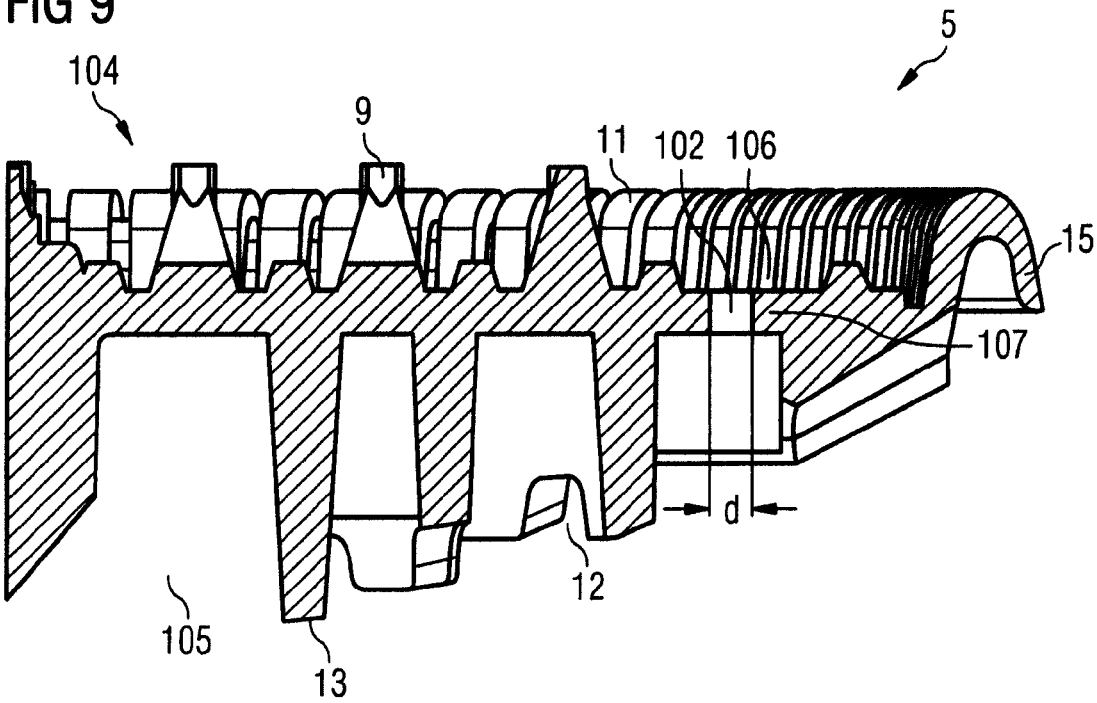
Figure 10:
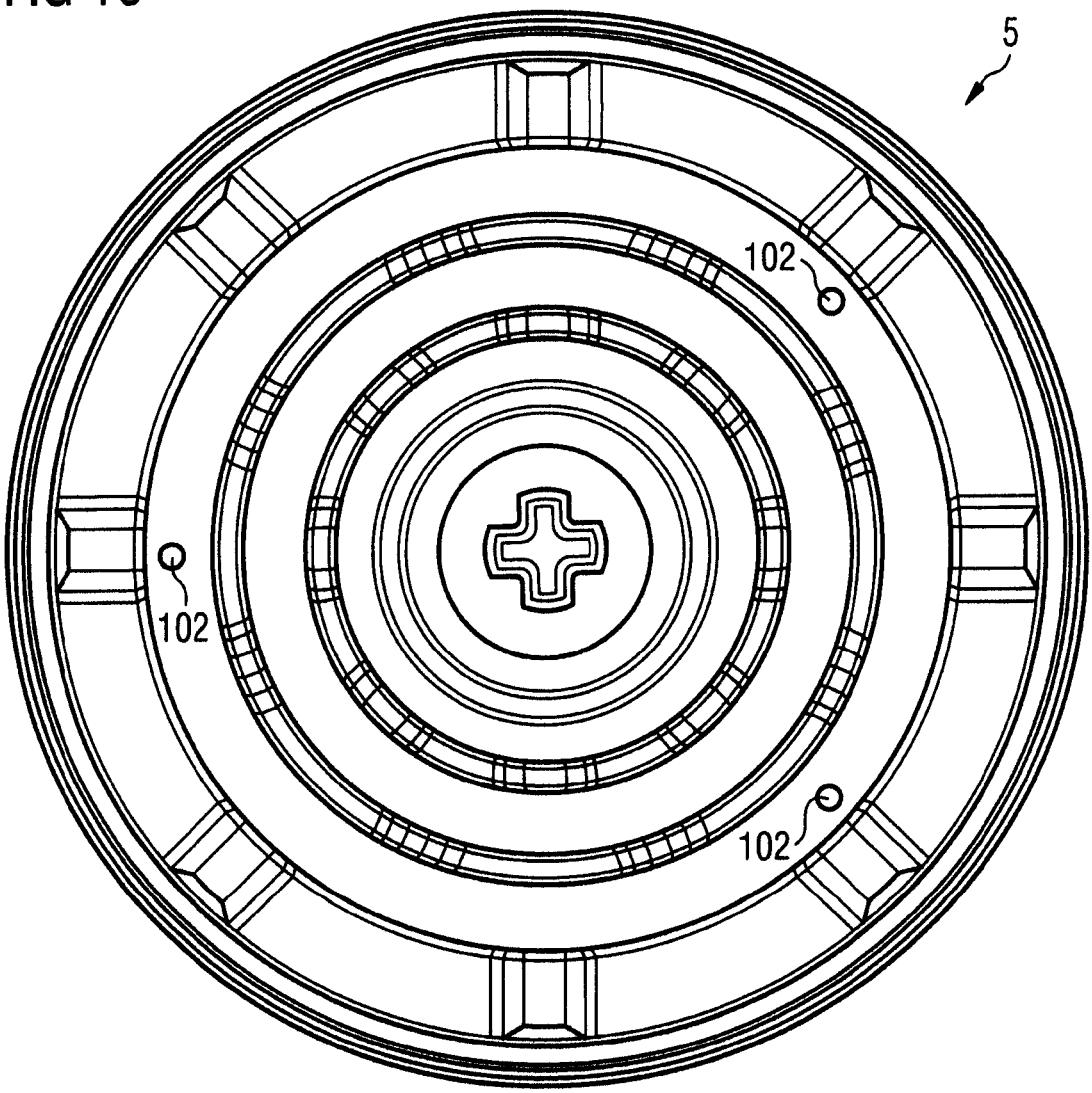
Figure 11:
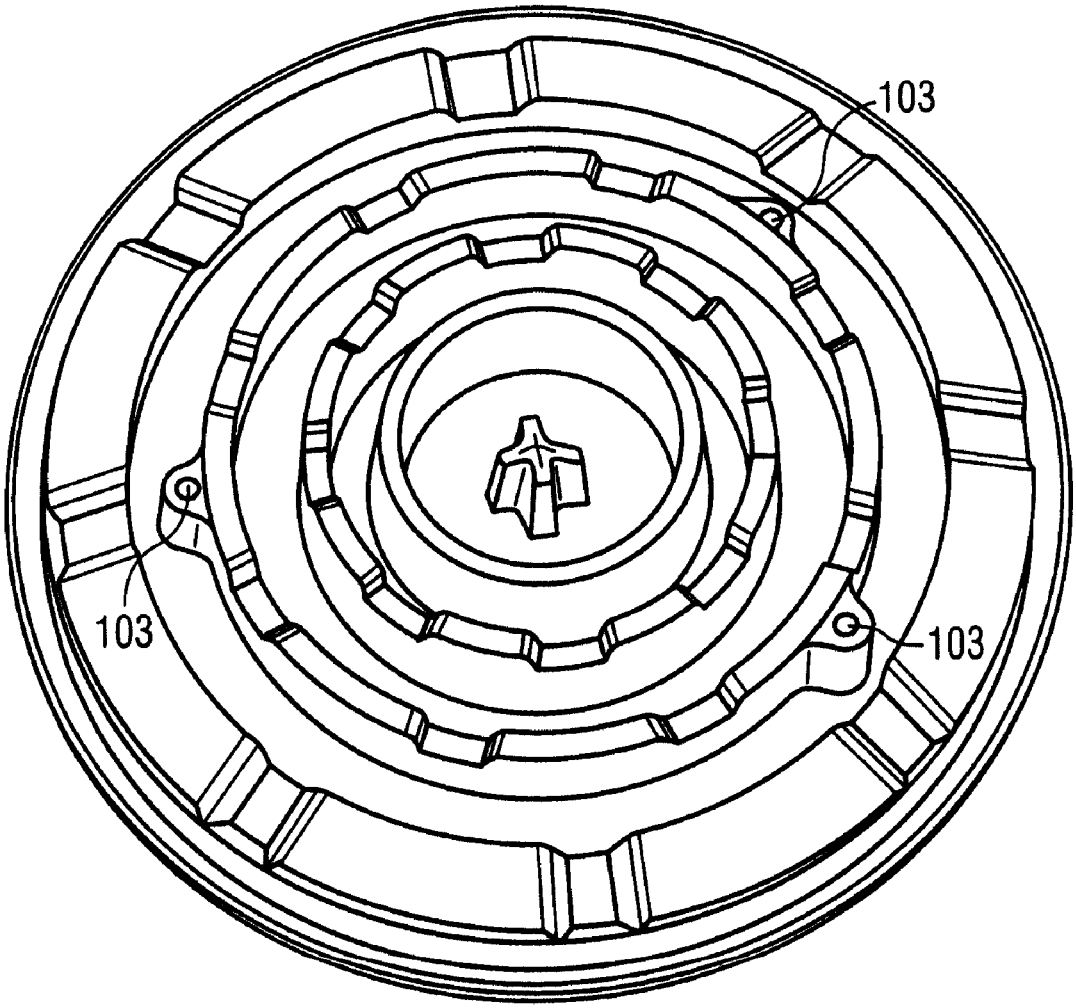

FIG. 1 shows a cross-sectional view of a capsule according to the present invention, having an opening plate (5) with at least one through hole, FIG. 2 shows an example for an opening plate (5) (perforation plate (5)), FIG. 3 shows the lower side of the perforation plate (5) of FIG. 2, FIG. 4 shows an enlarged view of the engagement between the perforation plate (5) and the adjacent walls of the capsule and illustrates the through holes, FIG. 5 shows a first embodiment for an automatic reclosing of the inlet face of the capsule after retraction of water injection means, FIG. 6 shows a second embodiment for auto-closing means of the perforation in the inlet face of the capsule, FIG. 7 shows a capsule with integrated water inlet port, FIG. 8 shows details of the functionality of the water inlet port of the capsule according to FIG. 7, FIG. 9 shows a cross-sectional view of a contoured opening plate of the invention having at least one through hole, FIG. 10 shows a view from below of the opening plate in order to illustrate the distribution of the through holes, and FIG. 11 shows a further embodiment for an opening plate having pressure-relief holes according to the present invention.

With reference to FIG. 1 at first the general principle to be applied with the present invention will be explained.

FIG. 1 shows a capsule 1 having a sealed ingredient compartment 3 which is designed to contain beverage or liquid comestible ingredients. Before the use of the capsule 1 in an associated adapted beverage production machine, the ingredient compartment 3 is hermetically sealed against the exterior. The opening of the ingredient compartment 3 at an inlet side of the capsule 1 is respectively is effected by an interaction of the capsule 1 with means of the beverage production machine.

Attaching a foil, or membrane, etc. to an upper flange-like extension 8 of the capsule walls can e.g. seal the top surface 2 of the capsule 1 in an airtight fashion. As will be explained later on in detail with reference to FIGS. 5 and 6, the surface 2 can be opened e.g. by perforating it with external perforation means, i.e. perforation means which are part of the beverage production machine.

The outlet side 4 of the ingredient compartment 3 is e.g. opened by the effect of increasing the pressure inside the ingredient compartment 3 above the ambient pressure, i.e. the pressure outside the capsule 1. To this regard, the face 4 of the ingredient compartment 3 to be opened can be made to engage with opening means which can be housed in the capsule 1 (as shown in the embodiment of FIG. 1) or which can be means which are external to the capsule 1. Thus the opening of the outlet side 4 of the capsule 1 is effected by a relative displacement of parts of the capsule itself and thus preferably without an interaction with parts of the beverage production machine.

In any case, when injecting e.g. water into the ingredient compartment 3 through the top surface 2, the lower face 4 will increasingly be engaged with the opening means of the capsule until a certain threshold value is reached and the lower face 4 will open against the perforation means 5.

In the embodiment shown in FIG. 1, which is meant to be a non-limiting illustration only, the lower face 4 acts against perforation or generally opening means 5 which is integrated into the capsule 1.

The opening means preferably are made from plastics.

Particularly, as can also be seen in detail in FIG. 2, the opening means can be a contoured opening plate 5, such as for example a plate 5 which is contoured such as for example by having little pyramids 9 or other small protrusions at the side opposing the lower face 4 of the ingredient compartment 3.

The opening plate 5 is arranged to perforate the lower face 4 of the ingredient compartment. Preferably, the opening plate is arranged to perforate a plurality of orifices in the lower surface. The opening plate 5 is supported by a preferably conical seat portion 107 of the outer wall of the capsule 1 in order to withstand the forces when the lower face 4 is pressed against the opening plate 5 by the internal pressure of the ingredient compartment 3.

Thus, when increasing the pressure inside the ingredient compartment 3, the lower face 4 will eventually tear against the pyramids 9 of the perforation plate 5.

According to the invention the opening member (perforation plate 5 in the depicted example) is provided with one or a plurality of through holes 100. The design, arrangement and distribution of the one or more through holes 100 will be explained later on with reference to FIG. 4 and particularly FIGS. 9 and 10.

The shown perforation plate 5 thus is designed to generate one or a plurality of openings in the lower face 4 and a beverage being the product of the interaction of the water with the ingredients in the ingredient compartment 3 will flow through the opening(s) into the interstices between the side walls of the pyramids 9 or other protrusions of the perforation plate 5.

Due to the high shear forces created at the interstice between the pyramids and the openings in the foil and the high pressure drop created by the conjunction of the pyramids and the foil, the foam or crema is created at the interstice when ingredients are foamable, e.g., with coffee or protein-containing powder.

The beverage flows at the periphery 10 of the member 5 toward the circumferential wall of the perforation plate 5 and evacuate through the gap created when the flexible lip 15 is flexed under pressure and the side wall 6 of the capsule.

The beverage flow is schematically illustrated in FIG. 1 by little arrows.

When the ingredient compartment 3 is pressurized, the liquid will be able to flow in a space between the perforation plate 5 and associated conical walls 6 of the capsule 1 towards a beverage outlet 7 of the capsule.

Therefore, in the region of the conical walls 6 the beverage flow essentially follows the inner side of the capsule walls 6.

Means can be provided for ensuring that the beverage leaves the beverage outlet 7 in a smooth manner. These means can e.g. be a guiding pin 14 arranged in the centre of the beverage outlet opening 7. The guiding pin 14 can be an integral part of the perforation plate 5 and protrudes downwards from the lower face of the perforation plate 5. Preferably, the guiding pin 14 tapers at its lower section outwardly.

Therefore, the beverage coming from the periphery of the perforation plate 5 will be smoothly guided by the cooperation of the beverage outlet opening 7 and the guiding pin 14 and preferably leave the capsule 1 in a steady flow.

This is particularly of importance in case the so-called "direct-flow" principle is used. According to the direct-flow principle, the beverage leaving the beverage outlet opening 7 of the capsule 1 is made to directly flow into a cup or another receptacle without any additional guidance by parts of the beverage production machine. As there is no additional guidance of the beverage flow leaving the capsule 1, it has to be ensured that the beverage leaves this beverage outlet opening 7 smoothly in order to avoid the beverage splashing into the cup or another receptacle.

Note that according to the direct-flow principle, the capsule 1 does not necessarily have to be arranged in a vertical orientation as indicated in FIG. 1, but can also be arranged in any position inclined to the vertical, such as for example a horizontal position. While in the position as shown in FIG. 1 (vertical arrangement) the beverage will leave the beverage outlet 7 in a direction flushing with the rotational symmetrical axis of the capsule 1, the beverage outlet flow will describe an angle towards this symmetry axis of the capsule 1 in case the capsule 1 is arranged in a position inclined to the vertical.

In addition or alternatively to the guiding pin 14 further measures can be taken in order to promote a smooth flow of the beverage coming from the beverage ingredient compartment 3. As shown in FIG. 3, the lower side of the perforation plate 5 can be provided with several rings 13 arranged coaxially to the centre of the perforation plate 5, in which centre the guiding pin 14 can be arranged.

The coaxial rings 13 are respectively provided with a plurality of recessions 12, wherein recessions 12 of neighbouring rings 13 are offset relative to each other regarding their angular position when measured to the centre of the perforation plate 5.

The areas of the rings 13 outside the recessions 12 can be made to be in full contact with the associated walls 6 of the capsule 1 or at least such that they represent a flow obstacle for the beverage stream.

In any case, as indicated in FIGS. 1 and 4, the cooperation of the offset recessions 12 with the wall 6 of the capsule 1 will force the beverage into a meandering (tortuous) path, wherein the walls defining the path break the energy of the beverage jet and promote a smooth flow towards the beverage outlet opening 7.

Additionally, in the area surrounding the beverage outlet 7, the walls 6 of the capsule 1 can be provided with an outwardly extending bead 27, which also promotes a steady flow and an energy-breaking effect of the beverage jet.

As can be seen from FIGS. 3 and 4, the periphery 10 of the perforation plate 5 can optionally be provided with a flexible lip 15, which is biased against the wall 6 of the capsule. When seen in the flow-direction of the beverage flow path, the lip 15 can form an acute angle with the associated wall 6 of the capsule 1. As long as the ingredient compartment 3 is pressurized, the beverage flow 15 will be able to push the flexible lip 15 inwards in order to open a flow path.

The flexible lip 15 thus represents just one illustrative embodiment for having a selective valve means, which closes the flow path from the ingredient compartment 3 to the beverage outlet 3 in case the beverage ingredient compartment 3 is not pressurized. Thus, as soon as the water injection into the ingredient compartment 3 stops, the flexible lip 15 will shut off the flow path between the plate 5 and the wall 6 of the capsule. Thus, e.g. any remaining water in the ingredient compartment 3 or on the top surface of the perforation plate 5 can no longer exit towards the beverage outlet opening 7.

Additionally, the optional valve means, such as for example the flexible lip 15, can be made to cut-off even any airflow between the exit opening 7 and the water injection opening produced in the inlet side 2 of the capsule 1. This has the advantage that by at least drastically reducing the air flow through the capsule 1, the amount of liquid or solids which can leave the interior of the capsule 1 e.g. through the injection opening at the top surface 2 of the capsule can be reduced for a lack of compensating air.

Note that many different valve arrangements and positions for the valve can be thought of, as long as the valve means are adapted to be at least an obstacle through to a flow of air and/or liquid between the beverage outlet opening 7 and the water injection opening at the top surface 2, and vice-versa.

In FIG. 4 it is also shown that the opening means (e.g. the depicted perforation plate, etc.) 5 can have one or more through holes (100 in FIG. 1)

- as one or more through holes 101 which connect the side wall of the contours (e.g. pyramids) 9 with the lower side of the opening means 5,
- as one or more through holes 102 which connect a "valley" between adjacent contours (e.g. pyramids) 9 with the lower side of the opening means 5, and/or
- as one or more through holes 103 which connect the top of a contour (e.g. pyramids) 9 with the lower side of the opening means 5.

Later on particularly the through holes 102 and generally the function of the through holes 102 will be explained in detail with reference to FIGS. 9 and 10.

FIGS. 5*a*-5*c* as well as FIGS. 6*a*-6*c* show alternative means for prohibiting liquid and/or solids leaving an opening 18 in the top surface 2 of the capsule 1 which opening 18 is produced by introducing the water injection means 16.

In the embodiment of FIG. 5 a self-sealing material 17 is attached to the upper side and/or the lower side of the top surface 2. As shown in FIGS. 5*a*-5*c*, the water injection means 16 will go through the self-sealing material 17 as well as the foil or membrane of top surface 2. Once the water injection is completed, the water injection means 16 will be retracted (FIG. 5*c*) leaving an opening 18 at the top surface 2. According to the invention the material 17 is e.g. an elastomer, a silicone material etc. which is enable to "seal" automatically the opening made by the water injection means 16.

FIGS. 6*a*-6*c* show a slightly different approach in which self-sealing material forming a layer 19 is attached to the interior of the top surface. Again, both the top surface 2 material as well as the self-sealing material 19 will be perforated by the perforation means 16 in order to carry out the water injection. Once the water injection and perforation means 16 are retracted (FIG. 6*c*), the expanding material 19 will seal the opening 18 left by the water injection perforation member 16. The expanding material 19 can e.g. be made from a super-absorbing polymer (SAP) which can take up e.g. up to 100 times of its own weight of water. A layer of this expanding material 19 can be installed e.g. as an inner film or by hot melting under a membrane forming the top surface 2. The expanding material can e.g. absorb water and then be transformed into a gel, which blocks the opening 18.

FIG. 7 shows an embodiment of the capsule 1 which is provided with its own water injection port 20. The water injection port 20, being sealed via means 21 vis-à-vis the top surface 2 of the capsule 1, is part of the capsule 1 and not of the associated beverage production machine. As can be seen for example from FIG. 8*b*, a water injection port 23 can be docked in a sealed fashion to the port 22 of the capsule 1. As can be schematically seen in FIG. 8*a* and 8*b*, preferably the water injection port 22 of the capsule 1 has a relatively small diameter in order to promote a capillarity effect. E.g., if the inner diameter of the water injection port 22 is between some 0.1 and 0.3 mm, a capillary effect will occur which retains water inside the port 22 even after the water injection pipe 23 of the beverage production device is removed. The water remaining in the form of a meniscus inside the port 22 will then represent an air barrier, i.e. air ingress is avoided and the loss of residual liquid from the capsule is reduced.

FIG. 9 shows in detail a through hole 102 in the opening plate 5 generally providing for a fluid connection between the upper side 104 and the lower side 105 of the opening member 5. In the shown example the through hole(s) 102 vertically connect a valley or recession 106 spaced from the contours 9 with the lower side of the opening member 5. Thus the through hole(s) 102 are preferably arranged in the thinnest portion 107 of the opening member 102.

FIG. 10 shows how a plurality of such through holes 102 can be distributed over the surface of the opening member 5 in a regular pattern. In the shown example the openings are arranged such that they all have the same distance to the centre of the opening member 5. For instance, they are equally distanced from each other.

FIG. 11 shows how a plurality (in the example three) of through holes 103 which are respectively arranged in a portion of the opening plate 5 having a relatively large thickness (in contrast to the holes 102 in FIG. 10 which are arranged in thin areas of the opening plate 5).

The through hole 100, 101, 102, 103 are preferably dimensioned as capillary holes in the opening means 5 integrated in the capsule 1. "Capillary holes" means that the holes are designed such that they are capable of holding a liquid volume against the gravitational force such that such liquid volume will not drip from the holes.

As the holes 103 arranged in thicker portions of the opening plate 5 thus are relatively long (in comparison to their diameter), the capillary effect is promoted and dripping is reduced.

In view of the small diameter and/or number of the capillary holes the liquid flow during an ongoing beverage production process will essentially not take place through the capillary holes, but through the annular gap which is created between the flexible lip 15 and the inner side of the capsule wall 6 during the release of the beverage through the valve system and by effect of the pressure deforming the flexible lip 15.

The through holes primarily serve to release pressure inside the ingredient's chamber 3 of the capsule 1 at the end of the beverage production process to prevent backflow of liquid (which can be contaminated) through the injection hole in the top face of the capsule 1. As already explained, this backflow can be caused when the pump is switched off and a residual overpressure in the ingredient compartment expels liquid through the inlet of the capsule.

This pressure release through the through-opening(s) is particularly important for smaller volume of beverages delivered because no sufficient air volume can enter the capsule 1 and too much pressure can remain in the capsule 1 after the pump delivering the injected liquid is switched off and the injection needle is removed. Thus the backflow phenomenon can occur e.g. when producing a chocolate beverage when a volume as small as 60 mL of beverage is delivered through the capsule 1. The backflow phenomenon is less likely when producing a milk beverage where a volume of 140-160 mL of liquid is delivered.

The through-holes are dimensioned to avoid dripping when the pressure in the chamber has reached a sufficiently low value. The dripping is effectively avoided because of the meniscus effect of liquid provided in the holes.

In view of the capillary effect, i.e. in order to hold a liquid volume inside the holes, it is advantageous to provide a plurality of small holes, for example, diameter d in the range of 0.1-0.7 mm, in the pyramid opening plate 5. These dimensions are adjusted to the typical viscosity of the produced beverages, such as e.g. coffee, which viscosity also affects the capillary effect.

The number of through holes can be between 1 and 10, preferably between 2 and 5.

The provision of the through holes in the opening means integrated in the capsule results in a cleaner beverage production process:

A. After stopping the operation of the pump of the beverage production machine and before removing capsule holder from machine: The dripping of water at the outlet face stops faster.

B. Upon removing the capsule from the beverage production machine: There is no "backflow" of liquid from the interior of the capsule.

The capillary through holes can be used in combination with the anti-dripping valve (e.g. the depicted flexible lip) 15. The anti-dripping valve, as already explained above, selectively closes off the liquid flow path when the pressure inside the ingredient compartment 3 falls under a threshold value. In this state the opening plate 5 effectively closes off the ingredient compartment 3 as the through holes in the opening plate 5 will be blocked by liquid drawn in and held by the capillary effect.

Thus the capillary holes allow for a quick pressure release and will then block dripping by the capillary effect.

The anti-dripping valve opens the liquid flow path across the opening plate 5 at higher pressures inside the ingredient chamber 3.

This allows a faster delivery. However, one can also imagine an opening member using only capillary holes and no anti-dripping valve.

Therefore, a capsule with the capillary holes with or without valve should be protected.

In another mode, a valve means for controlling the release of beverage can be formed as a rubber-elastic valve as part of or in an insert separating the compartment and the outlet. A filter may additionally be inserted between the substance and the insert for filtering the beverage. For instance, the insert may comprise a valve with at least one slit or small hole, which opens at a certain threshold of pressure in the compartment for controlling the release of the beverage at a desired pressure and which closes when the pressure in the compartment falls under the opening pressure. Possible examples of cartridges with a valve is described in US2002/0078831 or EP 1579792. The insert may comprise additional capillary holes placed in parallel to the valve through the insert. The capillary through-holes primarily serve here also to release pressure inside the compartment of the capsule at the end of the beverage production process to prevent backflow of liquid (which can be contaminated) through the injection hole in the top face of the capsule.

The invention claimed is:

1. A capsule containing ingredients for producing a beverage, the ingredients are housed in a compartment and the capsule comprises:

a contoured opening plate designed to open a face of the ingredient compartment when the pressure inside the ingredient compartment presses the face against the opening plate of the capsule; and the opening plate comprises valve means and at least one capillary through hole connecting two opposing sides of the opening plate.

2. The capsule according to claim 1, wherein the through hole has a diameter of between 0.1 mm and 0.7 mm.

3. The capsule according to claim 1, wherein 1 to 10 through holes are provided.

4. The capsule according to claim 1, wherein the through hole is arranged in a recessed portion of the face of the opening plate which faces the compartment face to be opened.

5. The capsule according to claim 1, wherein a plurality of through holes arranged in a periodic pattern over the opening plate.

6. The capsule according to claim 1, wherein the valve means are designed to open a liquid flow path between a periphery of the opening plate and the capsule wall as long as the pressure inside the ingredient compartment exceeds a threshold value, and close off liquid flow path when the pressure inside the ingredient compartment drops below a threshold value.

7. The capsule according to claim 1, wherein the valve means comprise a flexible lip provided at a periphery of the opening plate.

8. The capsule according to claim 1, wherein the opening plate is supported by an outer wall of the capsule.

9. A capsule containing ingredients for producing a beverage comprising:

ingredients housed in a compartment;

the capsule comprises an insert placed between the compartment and an outlet; and the insert comprises valve means, and the insert is provided with at least one capillary through-hole connecting two opposing sides of the insert, the valve means are designed to open a liquid flow path between a periphery of the insert and the capsule wall as long as the pressure inside the ingredient compartment exceeds a threshold value, and close off liquid flow path when the pressure inside the ingredient compartment drops below a threshold value.

10. Capsule according to claim 9, wherein the insert is an opening plate designed for opening a face of the ingredient compartment when the pressure inside the ingredient compartment presses the face against the opening plate of the capsule.

11. The capsule of claim 1, wherein the opening plate is part of the valve means.

12. The capsule of claim 9, wherein the insert is part of the valve means.

* * * * *